United States Patent [19]

Fowler et al.

[11] 4,290,663

[45] Sep. 22, 1981

[54] IN HIGH FREQUENCY SCREENING OF ELECTRICAL SYSTEMS

[75] Inventors: Eliot P. Fowler, Tolpuddle; John R. Taylor, Wool, both of England

[73] Assignee: United Kingdom Atomic Energy Authority, London, England

[21] Appl. No.: 87,480

[22] Filed: Oct. 23, 1979

[51] Int. Cl.[3] ..... H01R 13/648

[52] U.S. Cl. ..... 339/143 R; 339/177 A; 174/35 C

[58] Field of Search ..... 339/163 R, 177 R, 177 A; 333/12; 174/35 R, 35 C, 36, 406 R, 109; 335/301

[56] References Cited

U.S. PATENT DOCUMENTS

| | | | |
|---|---|---|---|
| 3,215,768 | 11/1965 | Murphy | 179/36 |
| 3,219,951 | 11/1965 | Clark | 333/12 X |
| 3,541,473 | 11/1970 | Schlickeet al. | 333/12 |
| 3,982,060 | 9/1976 | Avery et al. | 339/177 R X |
| 3,990,765 | 11/1976 | Hill | 339/177 R |

OTHER PUBLICATIONS

Design of Shielded Cables Using Saturable Ferromagnetic Materials, D. E. Merewether, IEEE Transactions on Electromagnetic Compatability, vol. EMC-12, No. 3, Aug. 1970, p. 138.

Fundamentals of EMI Shielding, J. G. Robinson, Electro-Technology, Jun. 1966, pp. 36-39.

*Primary Examiner*—Eugene F. Desmond

*Attorney, Agent, or Firm*—Larson and Taylor

[57] ABSTRACT

An interconnection between screened cables and a method of interconnecting screened cables. It is calculated that reduction of magnetic reluctance of the magnetic path between inner and outer surfaces of the screen in the region of the interconnection decreases external interference to the screened cable and the interconnections are constructed to be in accordance with this calculation. Mu-metal can be used to reduce magnetic reluctance.

8 Claims, 11 Drawing Figures

IN HIGH FREQUENCY SCREENING OF ELECTRICAL SYSTEMS

BACKGROUND OF THE INVENTION

This invention relates to high frequency screening of electrical systems. The importants of screening against extraneous noise in an industrial environment is well recognised with the result that component design and layout aims at high efficiency screening which is quantified by a low transfer impedance across the conducting members forming the screen surrounding a sensitive circuit. The invention concerns preservation of this property where an otherwise continuous screen is interrupted for either connection to a further screen as in connections between cables and components or connection to a terminal screen structure such as between a component screen and a closure plate. Some aspects of design of mating faces at such interruptions are discussed in a paper entitled "Screened Coaxial Cable Connections for High Sensitivity Systems" by E. P. Fowler presented at an IEEE Symposium on Electromagnetic Compatibility at Montreux in May 1975.

SUMMARY OF THE INVENTION

According to one aspect of the present invention there is provided an interconnection between two parts of an annular electrically conductive screen incorporating a means of reducing the magnetic reluctance of the magnetic path between inner and outer surfaces of the screen in the region of the interconnection. Improvement in connector screening is possible by separation of the two contact rings combined with a reasonable length of separate conducting paths. Further improvement can be made by insertion of a high permeability magnet material such as a small toroid of laminated mu-metal between the conducting paths.

According to another aspect of the invention, a method of electrically connecting an outer conductor of a screened co-axial cable to a co-axial cable connector or to a terminal comprises making two connections between the outer conductor of the cable and the connector or component terminal to reduce the magnetic reluctance between them. Preferably, a magnetic toroid is interposed between the two connections. High frequency disturbing currents flowing in the outer wire braid conductor of the cable flow through the connection between the outer co-axial braid connection and the connector or component terminal, whilst the inner braid connection forms the screened circuit.

DESCRIPTION OF THE DRAWINGS

Embodiments of both aspects of the invention will now be described by way of example only with reference to the accompanying drawings, in which.

Figure 1:
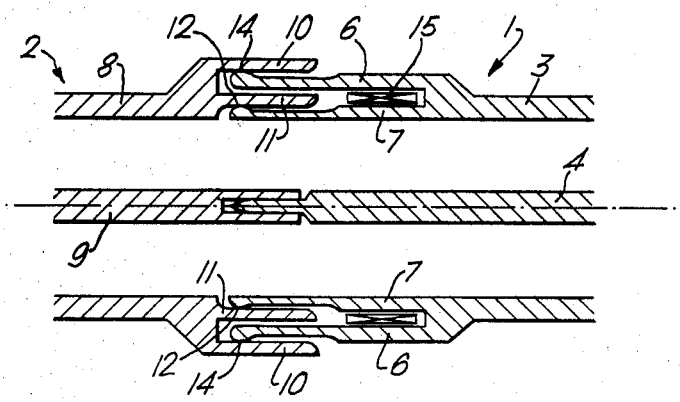
FIG. 1 is an axial cross section of a screened coaxial connector.

Reference is made firstly to FIG. 1, wherein a plug 1 is shown to the right and a socket 2 to the left. The plug 1 has an outer screen part 3 and an inner conductor 4. The outer conductor screen part 3 terminates in two parallel split skirts 6 and 7. The socket 2 has an outer screen part 8 and an inner conductor 9. The outer conductor screen part 8 terminates in two solid skirts 10 and 11. The skirts 6, 7 engage with a push fit into the skirts 10, 11. The skirts 6, 7 of the socket are shaped so as to make ring contacts 12, 14 with the inner circumference of the skirts 10, 11 of the socket 2. A toroid of laminated mu-metal tape 15 is retained between the split skirts 6 and 7.

Figure 2:
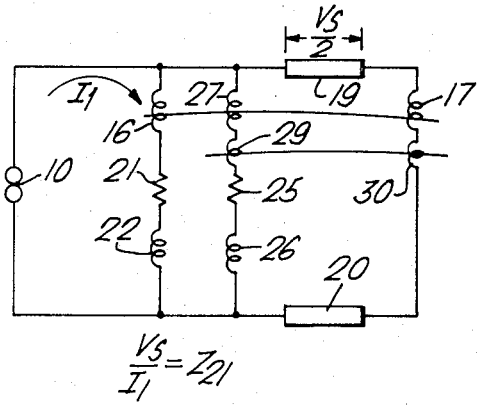
FIG. 2 is a simplified circuit diagram showing parameters connected with the FIG. 1.

Reference is now made also to FIG. 2. Screening effectiveness is related to the transfer impedance indicated by $Z_{21}$. Transfer impedance relates voltage generated in the screened circuit formed by the inner conductor and the connector outer screen to the disturbing current flowing only in the connector outer screen. In FIG. 2, there is shown an equivalent circuit for the co-axial connector of FIG. 1, which is being disturbed by a current I, so resulting in a voltage $V_5$ being generated in the screen circuit, so that $Z_{21}=V_5/I$. There are two concentric contact paths 12, 14 between the plug and socket of FIG. 1. In this system, a large part of inductance 16 of the outer conductor outer contact path 14 is coupled to the inner conductor at 17. Part of the voltage $V_5$ generated in the screen circuit appears across each of load resistances 19, 20 which complete the circuit but are not relevant to screening. These are also circuit elements (not shown) representing the distributed inductance and capacitance of the screened circuit, but these are omitted for clarity and they do not affect screening. The disturbing current I, from any external generator 10 flowing in the outer conductor generates a voltage across contact resistance 21 and reactive impedance 22. This reactive impedance is uncoupled inductance and occurs if the contact path is not circumferentially uniform. The same disturbing current flowing in the coupled outer conductor will generate equal voltages across 16 and 17 and so have no effect on the screened circuit.

As well as the contact path 14, there is also the inner contact path 12 to be considered. The inductive impedance between these paths differs and in FIG. 2, the contact resistance of path 12 is indicated by 25 and its uncoupled inductance by 26. The inner contact path has a coupled inductance 27 which is coupled to the outer path and to the inner conductor. A further inductance 29 on the inner contact path 12 is coupled only to the inner conductor at 30 and represents the difference of the inductive impedance.

Figure 3:
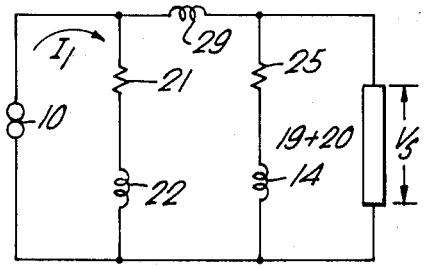
FIG. 3 is a simplification of FIG. 2.

The circuit of FIG. 2 can be simplified by eliminating the coupled inductances as is done in FIG. 3. From FIG. 3, it can be seen that the magnitude of the inductance 29 can play a significant part in governing the quotient $V_5/I_1$, ie the transfer impedance.

If $Z_1$ is taken to be the impedance of resistance 21 and inductance 22, $Z_2$ the impedance of resistance 25 and inductance 26 and $Z_M$ the impedance of inductance 29, then it can be shown that:

$$Z_{21} = \frac{Z_1 Z_2}{Z_1 + Z_2 + Z_M},$$

so that increase of impedance 29 results in decreased transfer impedance and improved screening. The inductance 16 has a value dependent upon axial length of the contact paths 12, 14 and on their ratio.

Figure 4:
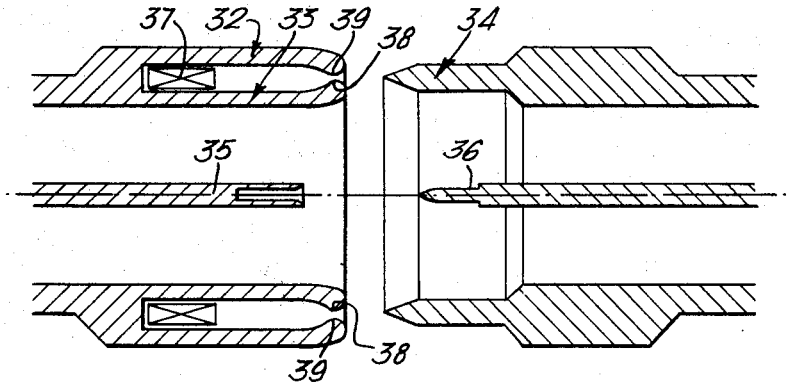
FIG. 4 is a similar view to FIG. 1.

Reference is now made to FIG. 4 the plug and socket connector depicted here in a decoupled condition employs two coaxial rings of split fingers 32, 33 on the left hand half arranged to define an annular socket to be engaged by single tube 34 on the mating right hand half of the connector simultaneously with the plug 36 and socket 35 inter-engagement of the inner conductor. A toroid 37 of mu-metal tape is retained at the base of the recess formed between the coaxial rings of fingers 32, 33. When the connector is engaged, two contact rings are formed at 38, 39.

The interconnection between the two parts in both of FIGS. 1 and 4 is electrically conductive along two coaxial or concentric paths physically spaced apart and electrically connected at each end and ferromagnetic material is located between the contact paths to reduce the reluctance of the magnetic path between them. The effect is to increase the inductive impedance of the inner contact "tube" thereby forcing a large part of the disturbing current to flow in the outer concentric "tube". Although the present description is applied in terms of the improved screening to disturbing current flowing in the connector screen, the principle of superposition can be applied to show that it is equally applicable to guarding against egress of signal from the screened circuit.

Figure 5:
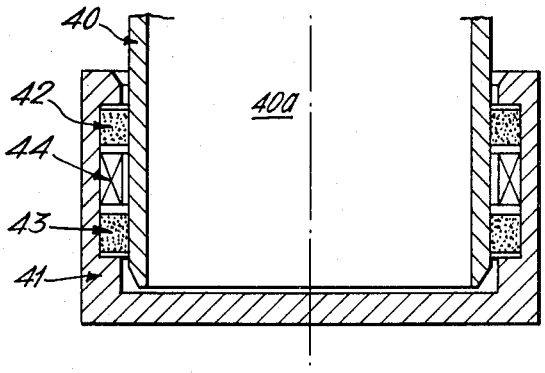
FIG. 5 is an axial cross section of a design applicable to a small screening box or a large diameter connector screen.

In FIG. 5, there is shown part of a right cylindrical screen 40 of a screened enclosure 41. The base of the screen 40 is closed by a circular cup 42, within which are ring contacts 43 and 44 of a resilient conductive material. The ring contacts 42, 43 are spaced axially in a recess in the cup 42. In the same recess, and between the rings, is located a toroid 44 of magnetic material. The toroid is of laminated construction, being formed from mu-metal tape.

Figure 6:
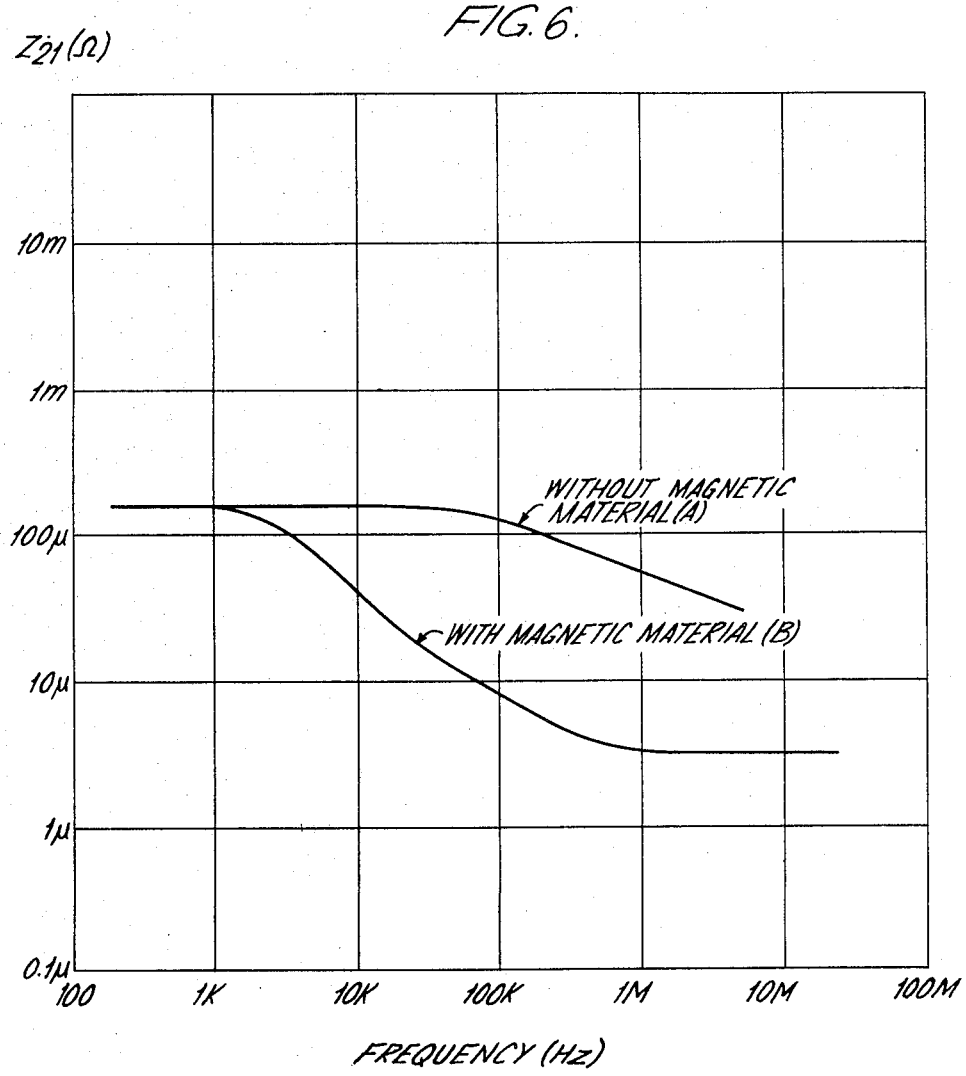
FIG. 6 is a graph showing comparative screening performance of the screen of FIG. 6 with and without a magnetic toroid.

In FIG. 6 is a graph showing transfer impedance $Z_{21}$ (in ohms) against frequency for the enclosure 41a sketched in FIG. 5. Curve A of FIG. 6 shows the transfer impedance without magnetic material in FIG. 5 while curve B shows the transfer impedance with the magnetic material present and demonstrates the lower transfer impedance which comes from incorporating the magnetic toroid. The improvement is such as to obviate the need of applying axial force to the connector at the interface which is otherwise found necessary to obtain good shielding. If there were only one ring contact then a curve drawn on a similar scale as curves A and B would have a zero or positive gradient and not a negative at higher frequencies. Thus, even provision of an air gap effects an improvement.

Reference is now made to FIGS. 7 to 11, which are similar views in axial cross-section of different forms of interconnection between a screened co-axial cable and co-axial connector and wherein like reference numerals are used for like parts in the Figures. The Figures show connection to a triple braided cable, but the connection is valid for all cables with two or more braids with or without the distributed interleaf of magnetic material. For example, in applying the invention to a double braided cable, the arrangement of FIGS. 7, 8, 10 and 11 omit the outer braid and tape. The arrangement of FIG. 9 would not be used if the middle braid and outer tape were omitted. If more than three conducting braids were to be used, the additional braids would be considered as either middle or outer braids.

In FIGS. 7 to 11, the cable 50 comprises a center conductor 51 insulated by a layer of insulation 52 from an outer conductor and screening feature 53. The cable's outer cover is indicated at 54, for the present purposes metal wire braid layers 55, 56, 57 are to be regarded as the outer conductor in conjunction with metal tape layers 58, 59.

Figure 7:
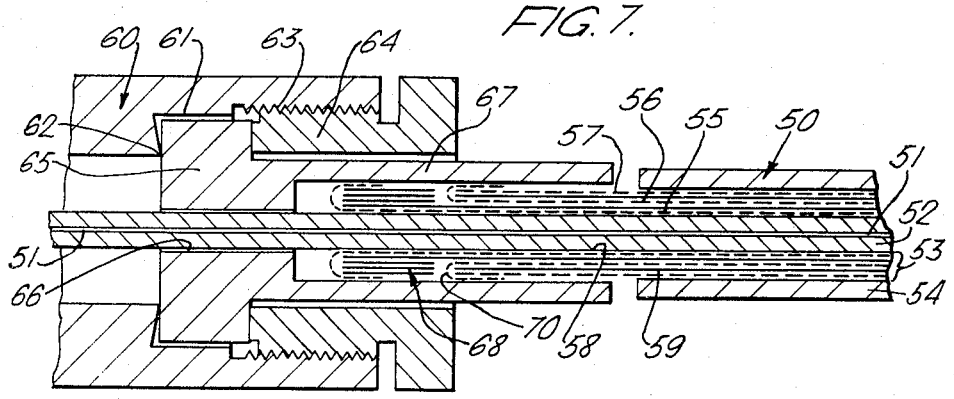
FIG. 7 is a view in axial cross-section of an interconnection between a screened co-axial cable and co-axial connector.
Figure 8:
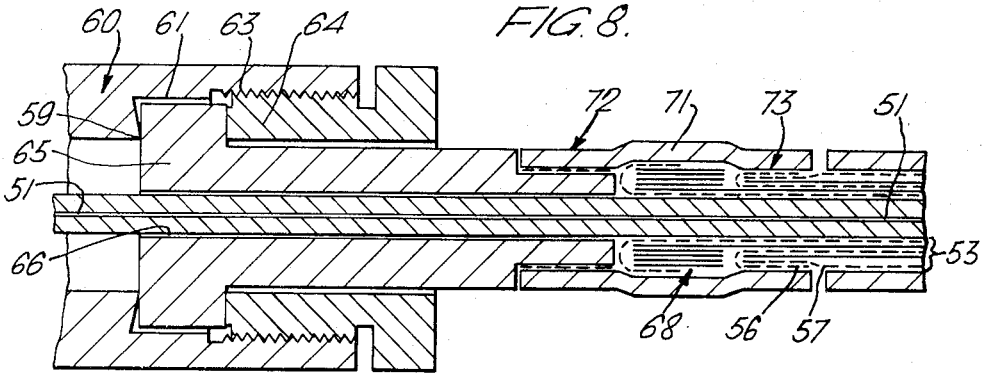
FIGS. 8 to 11 are similar views to FIG. 7, but of different forms of interconnection.

The drawings show only the rear end of a cable connector 60 for receiving the centre conductor 5 and, to which connector, the feature 53 is to be connected. In FIGS. 7 and 8 the rear end of the connector has a counterbore 61 whose internal shoulder is machined to an annular knife edge 62. An internal screwthread is formed at 63. An externally threaded metal back nut 64 screws into the screwthread at 63 and urges the end face of a ferrule 65 against the knife edge 62 to give good coaxial electrical contact and hence a good electrical screen. This is a technique used on several connectors. A small diameter hole 66 in the front of the ferrule 65 leads the insulated centre conductor 51 into the body of the connector 60 whilst in FIG. 1 an enlarged diameter rear portion 67 of ferrule 65 receives the outer conductor and screen feature 53.

The feature 53 is common to FIGS. 7 to 11 and terminates in a specially prepared end of the co-axial cable. In more detail the co-axial cable comprises three co-axial tubular layers of copper wire braid 55, 56, 57 interleaved by layers 58 and 59 of mu-metal tape formed from partially overlapping helical turns, each layer being applied in a manner which leaves clearances (not shown specifically) between the tape layer 58 and the underlying braid 55. Reference to FIG. 7 shows that prior to the entry of the outer conductor and shield feature 53 into the larger diameter bore portion 67 of the ferrule 65, a significant proportion of the unwrapped turns of the tape layer 58 are superimposed at 68 and having been very slightly bowed in their initial application to the braid 55, the superimposed turns exhibit resilience in a radial sense with respect to the cable axis. The underlying braid layer 55 is then folded back over the outermost of the superimposed turns, care being taken to ensure that the ends of braid 55 cannot touch the braid at 70. The centre braid layer 56 is folded back over both the enclosing tape layer 59 and outer braid layer 57. Thus prepared, the outer conductor and screen feature 53 is radially compressed manually and entered into the enlarged bore of the ferrule where two rings of contact will be maintained by the outward spring force of the superimposed tape turns 68 pressing the braid 55, against the bore of portion 67 and braid 56 being trapped between the bore 67 and braid 57. Retention is assisted by the inner conductor 51 which engages plug/socket fashion with a mating part of the connector (not shown). Any suitable means may be used to effect more positive retention.

The remaining embodiments demonstrate modified constructions which incorporate a more positive means of retention. In all cases however the presence of a substantial volume of mu-metal tape adjacent the contact interface reduces the transfer impedance over a large frequency range thereby lessening the risk of degrading the screening efficiency at a location where a discontinuity of the cable screen occurs.

In FIG. 8 the ferrule 65 has a parallel bore and the adjacent end of the feature 53, prepared as before, abuts the end face of the ferrule 65. The superimposed tape turns 68 and 18 secured by means of a copper sleeve 71. The sleeve 71 is crimped at 72 over a knurled end portion of the ferrule 65 which here has its outer diameter suitably reduced to enable a satisfaction crimp of the copper sleeve to be achieved. The sleeve receives the prepared end of feature 53 and is crimped at 73 at its end remote from the ferrule where centre braid 56 is back folded over the outer braid 57.

Figure 9:
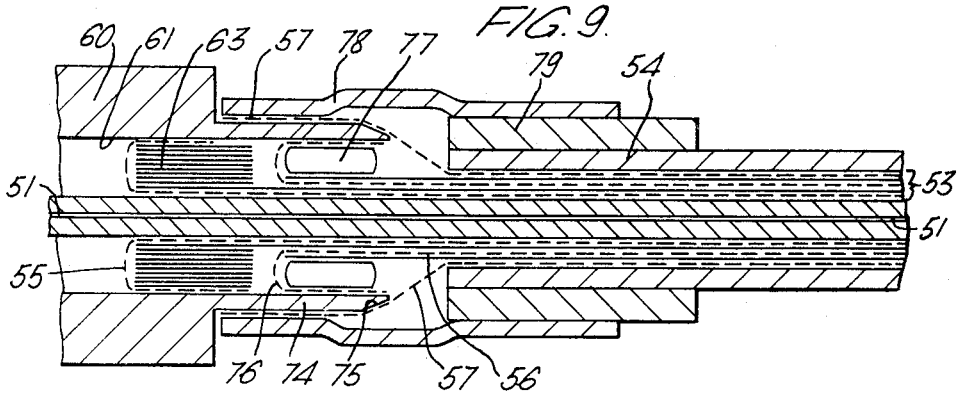

The embodiment shown in FIG. 9 omits the knife edge contact 62, ferrule 65 and back nut 64. Both the inner conductor 51 and the outer conductor 53 enter the bore 61 in the connector 60 and the resilience of the superimposed tape layers 68 urges the inner braid 55 into contact with the bore. The rear end of the connector 60 has a portion 74 of reduced external diameter with an end chamfer at 75. The middle braid 56 is folded back at 76 over an annular resilient distance piece 77 which maintains contact between the braid 56 and the bore 61. The outer braid 57 is led over the chamfered end 75 of the portion 74 on to its outer surface. The braid 57 is clamped to the outer surface of portion 74 of the connector by a copper sleeve 78 by the application of a crimping tool. The same tool crimps the same sleeve 78 to a compressable ferrule 79 slipped over the cable cover 54 to give additional mechanical cable grip.

Figure 10:
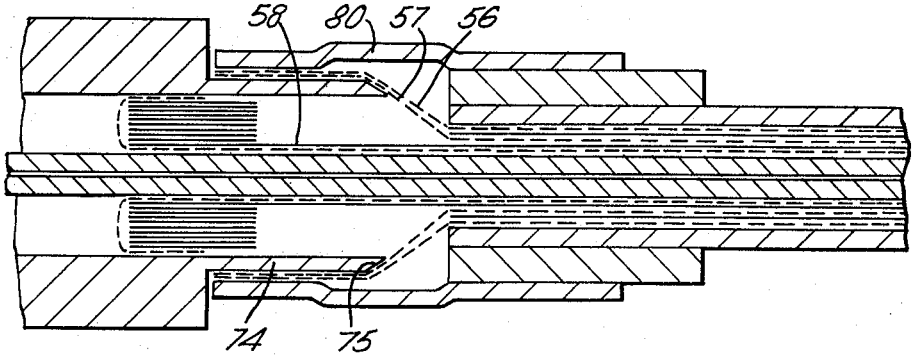

FIG. 10 shows a modification of the embodiment shown in FIG. 9 from which it differs by dispensing with annular distance piece 77 and the technique of folding back the wire braid 76. In FIG. 4 both braids 56, 57 are led over the chamfer 75 and are crimped to the connector by sleeve 80.

Figure 11:
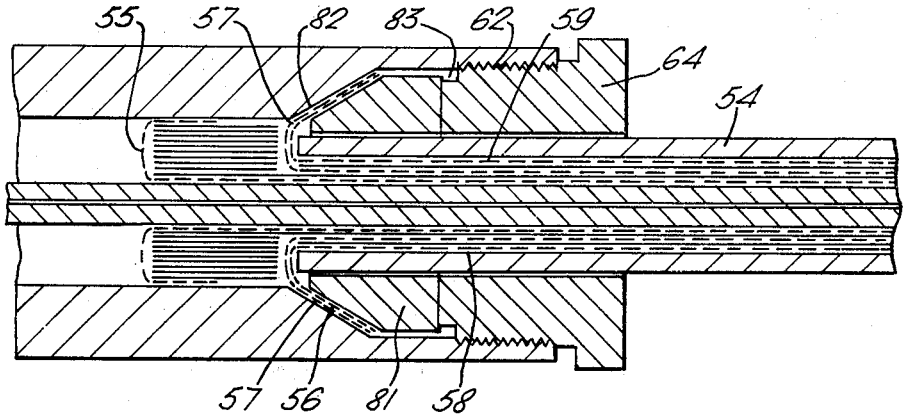

FIG. 11 shows a further modification which incorporates a wedge-piece 81 for the two outer braids 55, 56. At the near end of the connector body the parallel bore is followed by a divergent portion 82 followed by an enlarged diameter parallel portion 83, screw threaded internally at 84. The end preparation of the inner braid 55 and the superimposed tape turns are made up as before and entered into the enlarged diameter, parallel sided, bore, followed by the adjacent part of the cable cover 54, over which has been threaded an externally screw threaded back nut 64 and a wedge piece 85. The latter has a cone angle similar to that of the divergent portion 82 of the connector bore. The tape layer 59 is sheared off but the two braid layers 56, 57 are folded back obliquely over the wedge piece 85. The back nut 64 is screwed into the connector and urges the wedge piece 85 axially so clamping the two braid layers into the connector to provide a mechanical and electrical contact.

We claim:

1. In an annular electrically conductive screen having at least two annular electrically conductive screening paths, an interconnection between two parts of the screen, the interconnection comprising a region of at least one of the parts of the screen whereat the screen is physically divided to define a zone between the two annular paths, in which zone the two paths are physically separated, and an annulus of high permeability material disposed within said zone to reduce the magnetic reluctance of the magnetic path between said electrical paths, said annulus of high permeability material serving to partition a disturbing current so that substantially all of the current flows in that one of said paths which is closest to the disturbing signal.

2. A screen as claimed in claim 1 wherein said region is of such a form as to effect mechanical interconnection of the said two parts.

3. A screen as claimed in claim 1, wherein the annulus of high permeability material is of laminated form.

4. A method of electrically connecting the outer conductor of a screened co-axial cable to a co-axial connector or to a terminal, the method comprising making at least two connections between the outer conductor of the cable and the connector or component terminal and interposing between said at least two connections a magnetic toroid for reducing the magnetic reluctance between said at least two connections.

5. A method as claimed in claim 4, the outer conductor comprising co-axial layers of conductive braid interleaved by a layer of magnetic material, including positioning the toroid about a said layer of the braid, and folding the said layer back over the outside of the toroid.

6. A method as claimed in claim 5, wherein the said layer comprises the inner layer of the conductive braid.

7. A method as claimed in claim 5, wherein the magnetic toroid is provided by winding a tape of magnetic material about said layer of the conductive braid.

8. A method as claimed in claim 5, including radially compressing the folded layer about the toroid, and entering said compressed folded layer about said toroid into a bore in one part of the connector or terminal, the bore being arranged to inhibit unfolding of the braid.

* * * * *